United States Patent [19]

Meriwether, Jr.

[11] 4,304,078

[45] Dec. 8, 1981

[54] ADJUSTABLE SUPPORT APPARATUS

[76] Inventor: Irvin F. Meriwether, Jr., 622 Harriot, Beaumont, Tex. 77705

[21] Appl. No.: 31,955

[22] Filed: Apr. 20, 1979

[51] Int. Cl.[3] ..... E04F 21/00

[52] U.S. Cl. ..... 52/127; 52/749; 248/354 R; 248/354 S; 403/53

[58] Field of Search ..... 52/127, 749; 248/354 R, 248/354 S; 403/53

[56] References Cited

U.S. PATENT DOCUMENTS

| | | | |
|---|---|---|---|
| 2,101,317 | 12/1937 | Lemieux | 403/53 |
| 2,386,710 | 10/1945 | Pancoe et al. | 248/354 R |
| 3,030,061 | 4/1962 | Jennings | 248/354 S |
| 3,171,627 | 3/1965 | Tapley et al. | 248/354 S |
| 3,454,251 | 7/1969 | Dye | 248/354 R |
| 4,048,771 | 9/1977 | Thistlethwaite | 52/127 |

FOREIGN PATENT DOCUMENTS

| | | | |
|---|---|---|---|
| 907704 | 7/1945 | France | 52/749 |
| 72362 | 4/1970 | German Democratic Rep. | 52/127 |
| 299814 | 8/1964 | Netherlands | 248/354 S |
| 543853 | 3/1942 | United Kingdom | 248/354 S |

*Primary Examiner*—Alfred C. Perham
*Attorney, Agent, or Firm*—Bill B. Berryhill

[57] ABSTRACT

Adjustable support apparatus for temporarily supporting a door frame or the like in a fixed relationship with one or more fixed supports suitably spaced therefrom, comprising: an elongated brace assembly including first and second telescoping members movable between contracted and extended positions and a setting device for fixing the first and second members in one of the contracted and extended positions; a first connector assembly at one end of the brace assembly adapted for removable attachment to a door frame; and a second connector assembly at the other end of the brace assembly adapted for removable attachment to one of the fixed supports.

12 Claims, 4 Drawing Figures

ADJUSTABLE SUPPORT APPARATUS

BACKGROUND OF THE INVENTION

1. Field of the Invention

The present invention pertains to adjustable support or bracing apparatus. In particular, it pertains to adjustable support or bracing apparatus suitable for temporarily supporting door frames in proper alignment while masonry work is performed adjacent thereto.

2. Description of the Prior Art

In the construction of buildings, it is often necessary to support a wall or form prior to the attachment of other structural members which are to eventually hold the walls or forms in place. Traditionally, this has been done by temporarily nailing wooden supports to the walls or forms which are removed when they are no longer needed. However, such procedures are wasteful of both materials and time. For this reason, recent construction techniques have been developed utilizing adjustable supports or braces to take the place of wooden structural members. These adjustable supports or braces can be used over and over, reducing cost in both labor and materials. Examples of such may be seen in U.S. Pat. Nos. 3,030,061; 3,171,627; and 3,574,981.

Similarly, in the installation of door frames, specially those made of metal in commercial buildings, it is necessary to temporarily support the door frame prior to the erection of adjacent walls. This is particularly true in masonry construction where there is nothing to support the door frame until the adjoining masonry wall is formed thereabout. Consequently, it may be necessary to construct temporary support or braces of some sort to hold the door frame in place until the masonry work is completed. Adjustable and reusable supports have been developed in the past few years to accomplish this purpose. Examples are shown in U.S. Pat. Nos. 1,824,998; 2,914,813; 2,914,814; 3,027,686; and 4,048,771.

While the temporary door frame supports of the prior art are definitely better than supporting the door frame with lumber braces, they have not been completely satisfactory for various reasons. Many of them are bulky, cumbersome to use and susceptible to damage or the loss of parts. Others require attachment to the ground or floor which is not always easy to do. Furthermore, attachment to the door and some fixed support is not always easy to accomplish since the attachment devices are not universal in angle of attachment. In addition, most of these devices do not provide for fine adjustment so that the door frame may be easily and accurately aligned or plumbed. Others are not positively connected at both ends so as to reduce the hazards of falling on workers. Because of the deficiencies of the prior art, none of these devices have found widespread use.

SUMMARY OF THE INVENTION

In the present invention, adjustable support or brace apparatus is provided for temporarily supporting a door frame or the like in a fixed relationship with one or more fixed supports suitably spaced therefrom, i.e. a beam, column, bar stock or bar joist. The support apparatus of the present invention comprises an elongated brace assembly including first and second telescoping members movable between contracted and extended positions, and a setting device for fixing the telescoping members in a selected contracted or extended position.

Provided at one end of the brace assembly is a first connector assembly for removable attachment to the door frame. Provided at the other end of the brace assembly is a second connector assembly adapted for removable attachment to a fixed support. The brace assembly is provided with a fine adjustment device, manipulation of which extends or contracts the brace assembly by a relatively small amount.

The connector assemblies include several components which permit articulation of the brace assembly, relative to the point of attachment, about at least two mutually perpendicular axes. Thus, the adjustable support apparatus of the present invention provides a brace both of ends of which provide substantial universal movement for connection at a wide range of angles. Not only are the connector assemblies of the brace of the present invention universal in movement they are positively connected to the door frame and fixed support so as to eliminate any hazard of falling on a worker.

The adjustable support apparatus of the present invention provides not only easy and quick initial adjustment but easy and accurate fine adjustment. The combination of features of the present invention makes the present apparatus superior to those of the prior art and render the device more universally acceptable and usable. Many other objects and advantages of the invention will be apparent from the description which follows in conjunction with the accompanying drawings.

DESCRIPTION OF A PREFERRED EMBODIMENT

Figures 1, 2, 3, 4:
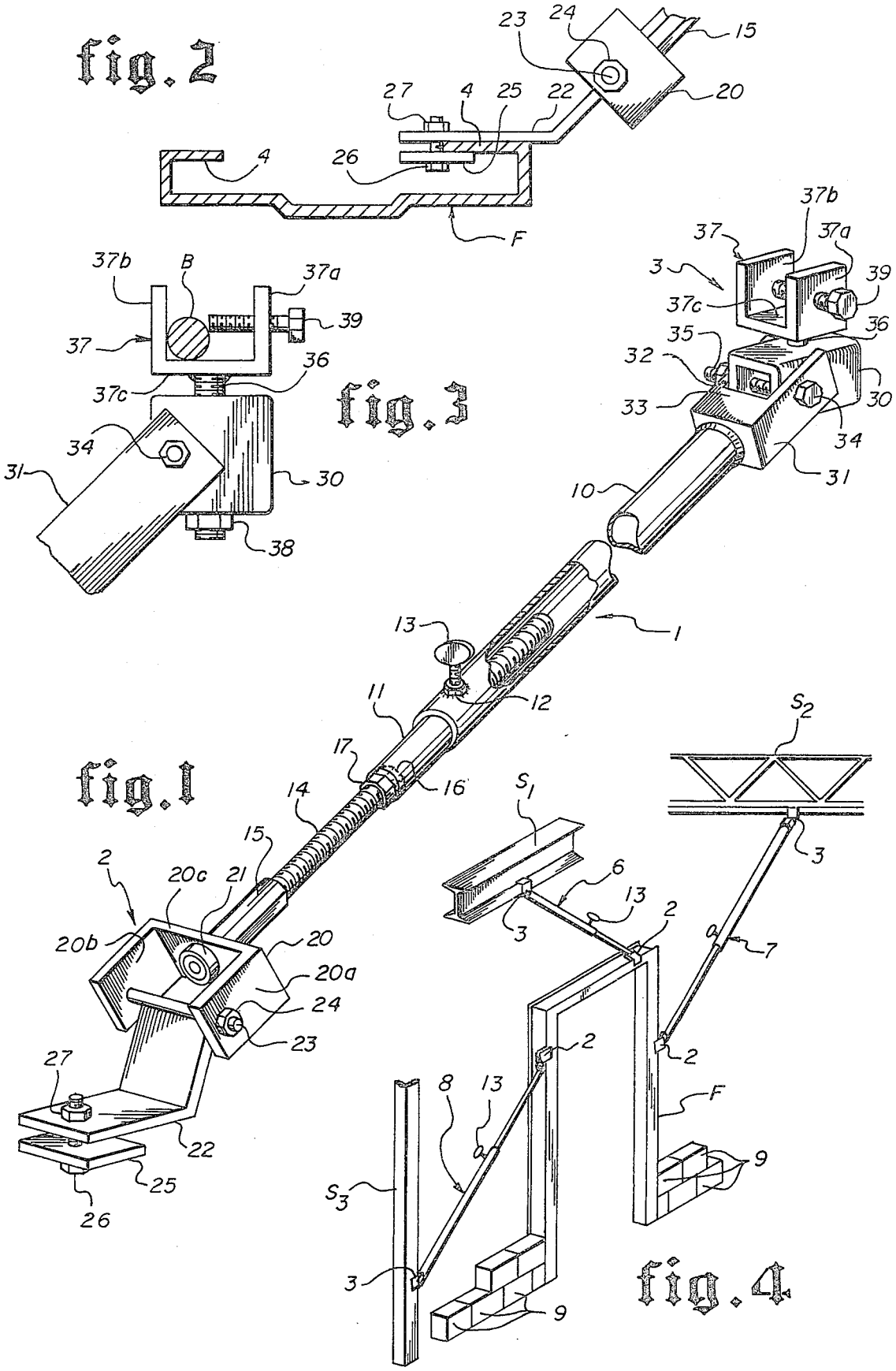
FIG. 1 is a perspective view of adjustable support apparatus according to a preferred embodiment of the invention.
FIG. 2 is a detail drawing showing a metallic door frame in cross section showing the attachment thereto of one end of the adjustable support apparatus of FIG. 1.
FIG. 3 is a detailed drawing showing the attachment of the other end of the adjustable support apparatus of FIG. 1 to a fixed bar member.
FIG. 4 is a pictorial illustration of a metallic door frame being temporarily supported by three adjustable support devices such as theone shown in FIGS. 1–3, while masonry work is being performed adjacent thereto.

Referring first to FIG. 1, the adjustable support apparatus of the present invention is made up of three major assemblies; an elongated brace assembly 1, a first connector assembly 2 at one end thereof, and a second connector assembly 3 at the opposite end thereof. As will be more fully understood hereafter, the first connector assembly 2 is adapted for removable attachment to a metallic door frame or the like, the second connector assembly 3 is for removable attachment to a fixed support suitably spaced from the door frame, and the brace assembly 1 is adjustable to span the space between the door frame and the fixed support.

The brace assembly 1 includes a first tubular member 10 and a second smaller tubular member 11 telescopically received therein. The telescoping members 10 and 11 are movable between contracted and extended positions. To fix these members in one position, a setting device may be provided including a nut 12 welded to the larger tubular member 10 and a thumb or set screw 13 engageable therewith. A hole (not shown) is provided in tubular member 10 coaxially aligned with the threaded hole of nut 12. Loosening of the thumb screw 13 allows the tubular members 10 and 11 to be quickly and easily contracted or extended. Tightening of the set screw 13 sets the tubular members 10 and 11 in the position selected. The smaller tubular member 11 is preferably selected of a material hard enough to stand abuse yet soft enough allow the set screw 13 to "dig in" when tightened. It will be noted that the nut 12 is positioned close to the end of tubular member 10 so as to allow the smaller member 11 to be telescoped out to the maximum length and yet be held in a sturdy position.

In should be pointed out that the clearance between the first and second telescoping members 10 and 11 should be sufficient to allow continued use even in cases where one or more of these members is slightly bent through use. This is important since in the use intended, support apparatus of the present invention will be subjected to hard use and possible abuse. This is particularly true when being used in conjunction with masonry work. In adjustable support apparatus of the prior art, small clearances have created problems after extended use and abuse.

While the telescoping arrangement of members 10 and 11 and the set screw 13 allows quick and easy length adjustment, it has been found desirable to provide some other means of fine adjustment. Accordingly, the support apparatus of the present invention provides a fine adjustment feature which includes a threaded member 14 such as all-thread, and a cooperating coupling nut 15 threadedly engaged therewith. In the exemplary embodiment, the threaded member 14 is attached to the smaller tubular member 11 by engagement with a nut 16 welded in the open end thereof. So that the threaded member 14 will remain fixed, it is threaded into the nut 16 and locked in place by a lock nut 17. It will, of course, be appreciated that the fine adjustment means and the first connector assembly 2 can be removed from the rest of the apparatus by loosening the lock nut 17 and unthreading the threaded member 14. This allows repair or replacement of any component of these subassemblies without having to discard the remainder of the apparatus. The purpose and use of the fine adjustment means will be more fully understood hereafter. For present purposes, it is sufficient to note that since the threaded member 14 is fixed, rotation of the coupling nut 15 relative thereto has the effect of extending or contracting, depending upon the direction of rotation, the length of the brace assembly 1 by relatively small amounts.

The first connector assembly 2 comprises a plurality of components including a first component 20 by which the connector assembly 2 is attached to the brace assembly 1. In the exemplary embodiment, the first component 20 is formed of a piece of channel iron having parallel flange portions 20*a* and 20*b* connected by a web portion 20*c*. The first component 20 is connected to the coupling nut 15 of the brace assembly 1 by a cap bolt 21. The cap bolt 21 extends through a hole (not shown) in the web 20*c* for engagement with the internal threads of the coupling nut 15. Preferably, the cap bolt 21 is provided with a Nylon insert which makes it self-locking. Thus the cap bolt 21 can be precisely adjusted so that the first component 20 is securely held to the coupling nut 15 but loose enough to allow rotation of the first component 20 about the central axis of the brace assembly 1. Since a cap bolt has a round head, it is preferable to a hexagonal bolt, allowing rotation of the first component 20 without the head digging into the web 20*c* as might occur with a hexagonal bolt.

Attached to the first component 20 is a second component 22 which in the exemplary embodiment resembles a bent leaf of a hinge, the joint of which is formed by a bolt 23, the ends of which are supported by the parallel flange portions 20*a* and 20*b* of the first component 20. The leaf may be welded to the bolt 11 to rotate therewith. Enough clearance is provided between the ends of the bolt and the holes in the flange portions 20*a* and 20*b* to allow the bolt to rotate. It is held in place by a nut 24 and the head of the bolt (not shown) at the opposite end thereof. The bolt 23 is perpendicular and slightly offset from the central axis of the brace assembly 1. Thus, the second component 22 pivots about an axis which is mutually perpendicular to the central axis of the brace assembly 1.

Attached to the second component 22 is a third component 25. In the exemplary embodiment, the third component 25 is a flat plate or square washer member attached to the distal end of the second component 22 by a fastener such as a bolt 26 and cooperating nut 27. The bolt 26 may be welded to the third component 25 so as to be fixed therewith. The bolt 26 extends through a hole (not shown) in the distal end of the second component 22 providing enough clearance so that the bolt 26 may freely rotate therein.

The second and third components 22 and 25 form a clamp by which the first connector assembly 2 may be removably attached to a door frame F, the cross section of which is represented in the detailed drawing of FIG. 2. Such metallic door frames F are normally provided with opposing lips 4 on the outer edges thereof, one of which may be clamped between the clamp formed by the first and second components 22 and 25. With the fastener 26, 27 in a loose position, the third component or square washer 25 is placed on one side of the lip 4 and the second component or hinge leaf 22 is placed on the other side. The entire support apparatus may be rotated about the axis of the bolt 26, as will be more fully understood hereafter, until the desired angular disposition is obtained. Then the nut 27 is tightened so that the fastener 26, 27 is operative for providing the force necessary for clamping the door frame lip 4 between the first and second components 22 and 25.

Thus, the first 20, second 22, and third 25 components of the first connector assembly 2 are attached to each other so as to permit articulation of the brace assembly 3, relative to the attachment with door frame F about at least two mutually perpendicular axes, the central axis of the brace assembly 3 and the axis of the bolt 23. In addition, prior to the full tightening of the fastener 26, 27 the brace assembly 1 can also be said to be articulated about the axis of bolt 26 which axis is substantially and mutually perpendicular to the axis of bolt 23.

Referring now specifically to FIGS. 1 and 3, the second connector assembly 3 will be described. The second connector assembly 3 is at the end of brace assembly 1 opposite the first connector assembly 2 and is adapted for removable attachment a fixed support such as the round bar stock B shown in cross section in FIG. 3.

The second connector assembly 3 includes a first component 30 by which the second connector assembly is attached to the brace assembly 1. To provide for such attachment, the end of the brace assembly may be provided with parallel extensions 31 and 32 which are welded directly to tubular member 10 or a piece of square tubing 33 which may be welded to tubular member 10. The first component 30, which may also be made of square tubing, is connected to the end of tubular member 10 by a bolt or shaft 34 the ends of which are supported by the parallel extensions 31 and 32. A nut 35 holds the bolt in place and allows enough force to be applied thereto to keep the first component 30 from needless flopping yet allowing pivoting thereof about the axis of the shaft 34. It will be noted that the axis of the shaft 34 is perpendicular to the central axis of the brace assembly 1.

Attached to the first component 30 by a bolt or similar threaded member 36 which extends therethrough is the second component 37. In the exemplary embodiment, the second component 37 is a short piece of deep channel to which the bolt 36 is welded. A nut 38 (see FIG. 3) is attached to the bolt at the opposite side of first component 30. The nut is preferably a self-locking type so that the second component 37 may be securely attached to the first but loose enough to allow 360° rotation of the second component 37 about the axis of the bolt 36. It will be noted that the axis of bolt 36 is mutually perpendicular to the axis of bolt or shaft 34.

The third component of the second connector assembly 3 comprises a threaded bolt 39 which engages a corresponding threaded hole in one of the flange portions 37*a* of the channel-like second component 37. The head of the bolt 39 is engageable from the outer side of flange portion 37*a* while the end thereof extends toward the inner side of the other flange portion 37*b*. It will be noted that the axis of bolt 39 is mutually perpendicular to the axis of bolt 36.

The second and third components 37 and 39, respectively, form a clamp by which the second connector assembly may be removably attached to a fixed support such as the bar stock B shown in the detail of FIG. 3. By placing the bar stock B between the flange portions 37*a* and 37*b* of the second component 37, and turning of the third component 39, the end of the third component 39 can be made to engage the fixed support (bar stock B) with enough force to positively but removably attach one end of the support apparatus thereto. The clamp formed by components 37 and 39 is such that it can also be attached to other structural members such as bar joists, I-beams, angle irons, etc.

It will be noted that the first, second and third components, 30, 37 and 39, respectively, of the second connector assembly are attached to each other so as to permit articulation of the brace assembly 1, relative to the point of attachment with the fixed support, such as bar stock B, about at least two mutually perpendicular axes, the axes of shaft 34 and bolt 36. In addition, if the third component or bolt 39 is not fully engaged, articulation may also be permitted about the axis of bolt 39, unless limited by engagement of the fixed support member, bar stock B, with the web portion 37*c* of the second component 37.

Referring now to all of the drawings, but particularly FIG. 4, installation and use of the adjustable support apparatus of the present invention will be explained. In FIG. 4, a metal door frame F, having a cross section similar to the one shown in FIG. 2, is shown being temporarily supported by three adjustable support apparatus 6, 7 and 8 according to a preferred embodiment previously described with reference to FIGS. 1–3. This is done so that masonry work, shown partially completed at 9, may progress to the point that the door frame F is supported by the masonry, allowing removal of the support apparatus 6, 7 and 8 while the masonry work proceeds to completion.

First, at least two and preferably three support apparatus 6, 7 and 8 are attached by the second connector assemblies 3 thereof to one or more fixed supports suitably spaced from the desired position on the frame F. For purposes of illustration, these fixed supports are illustrated as an I-beam $S_1$, bar joist $S_2$ and angle iron $S_3$. These fixed supports $S_1$, $S_2$ and $S_3$ are positioned in the clamp formed by the second and third components 37 and 39 of the second connector assembly 3 in a fashion similar to the placement of bar stock B shown in FIG. 3. The different types of fixed supports are shown merely to illustrate the universal type connection of the apparatus.

The support apparatus 6, 7 and 8 are then left to hang free at the second connector assembly 3 while the frame is stood up, placed in position, head leveled and shot or secured to the floor with fastening members. The support apparatus 6, 7 and 8, are then, one at a time, swung over to the frame F and fastened directly to the frame F by the first connector assemblies 2, as previously described with reference to FIG. 2. During this time, the set screws 13 are loosened, to allow the brace assemblies to be extended or contracted for adjustment to the space between the fixed supports $S_1$, $S_2$ and $S_3$ and the point of connection with the door frame F. As this is being done, the frame is generally and roughly plumbed to within one-fourth inch by hand leveling. The set screws 13 are tightened, setting the frame in a roughed in position, ready to be plumbed to a final position from floor level.

For final positioning, a plumb bob is generally hung from the frame F and a gauge placed between the frame and the plumb line for gauging in a manner well known in the art. Fine adjustment is accomplished by rotating the coupling nut 15, best seen in FIG. 1, to extend or contract the brace assemblies 1 by relatively small amounts until the frame F is plumbed.

It is to be noted that the foregoing procedure can be easily accomplished by one man. While connection of the second connector assemblies 3 may require that the installer use a ladder, connection to the frame F by the first connector assemblies 2 and fine adjustment of the frame can be done from floor level. It is also important to note that since both the first and second connector assemblies 2 and 3 are made up of components which permit substantially universal articulation, the support apparatus 6, 7 and 8 can be connected at almost any angle with the door frame F. It is also to be pointed out that, especially for masonry work, it is advantageous for the support apparatus to be connected overhead. This allows the masonry worker to work around the door frame without any obstructions. A worker can also pull a straight line on a string or cloth for alignment of the masonry without having to work around interfering supports. After the masonry is installed to a sufficient height, the support apparatus 6, 7 and 8 can be removed and the masonry work 9 completed around the frame F.

While the support apparatus of the present invention has been described primarily for use in aligning door frames F, it can also be used for aligning window frames, electrical panels, breaker boxes, and many other items. Furthermore, many variations in the use and construction of the adjustable support apparatus of the present invention can be made without departing from the spirit of the invention. Therefore, it is intended that the scope of the invention be limited only by the claims which follow.

I claim:

1. Adjustable support apparatus for temporarily supporting a door frame or the like in a fixed relationship with one or more fixed supports suitably spaced therefrom, comprising: an elongated brace assembly including first and second telescoping members movable between contracted and extended positions and setting means for fixing said first and second members in one of said positions, a first connected assembly at one end of said brace assembly adapted for removable attachment to said door frame, and a second connector assembly at the other end of said brace assembly adapted for removable attachment to one of said fixed supports; said first connector assembly including a first channel-like component having parallel flange portions connected by a web portion and attached to said brace assembly for rotation about the central axis thereof, a second component comprising the leaf of a hinge, the joint of which is formed by a shaft the ends of which are supported by said parallel flange portions of said channel-like component for pivoting about an axis substantially perpendicular to said central axis, and a third component attached to said second component forming a clamp by which said first connector assembly may be removably attached to the door frame.

2. Adjustable support apparatus as set forth in claim 1 in which said first, second and third components are attached to eachother so as to permit articulation of said brace assembly, relative to the point of attachment of said first connection assembly with said door frame, about at least two mutually perpendicular axes.

3. Adjustable support apparatus as set forth in claim 2 in which said second and third components are attached by a fastener which is operative to provide the force necessary for clamping a portion of said door frame between said first and second components.

4. Adjustable support apparatus as set forth in claim 3 inwhich, prior to operation of said fastener for providing said clamping force, articulation of said brace assembly is permitted about the axis of said fastener in addition to said mutually perpendicular axes.

5. Adjustable support apparatus as set forth in claim 1 inwhich said third component comprises a flat plate connected to the distal end of said leaf by a fastener, the distal end of said leaf and said flat plate being positionable on opposite sides of a portion of said door frame for clamping engagement therewith upon operation of said fastener for placing the necessary force therebetween.

6. Adjustable support apparatus for temporarily supporting a door frame or the like in a fixed relationship with one or more fixed supports suitably spaced therefrom comprising: an elongated brace assembly including first and second telescoping members movable between contracted and extended positions and setting means for setting said first and second members in one of said positions, a first connector assembly at one end of said brace assembly adapted for removable attachment to said door frame, and a second connector assembly at the other end of said brace assembly adapted for removable attachment to one of said fixed supports; said second connector assembly including a first elongated rigid component attached to said brake assembly by a shaft member whose axis is perpendicular to the central axis of said brace assembly and the ends of which are supported by parallel extensions projecting from said brace assembly, a second component attached to said first elongated rigid component for rotation about a third axis mutually perpendicular to said shaft axis and a third component attached to said second component forming a clamp by which said second connector assembly may be removably attached to said fixed support.

7. Adjustable support apparatus as set forth in claim 6 in which said second component is attached to said elongated rigid member by a bolt the axis of which coincides with said third axis.

8. Adjustable support apparatus as set forth in claim 7 in which said second component comprises a channel-like member having parallel flange portions connected by a web portion, said web portion being perpendicular to said third axis.

9. Adjustable support apparatus as set forth in claim 8 in which said third component comprises a threaded bolt member threadedly engaging a threaded hole in one of said second component flange portions and having a head thereon for rotating said bolt member to engage said fixed support member for clamping said fixed support member between said second component flange portions.

10. Adjustable support apparatus as set forth in claim 1 or 6 in which one of said telescoping members is provided with fine adjustment means including a threaded member and a corresponding adjustment nut relative rotation of which extends or contracts said brace assembly by relatively small amounts when said first and second telescoping members are fixed in one of said positions by said setting means.

11. Adjustable support apparatus as set forth in claim 10 in which said threaded member is fixed relative to said telescoping members, rotation of said adjustment nut effecting said small amounts of extension or contraction of said brace assembly.

12. Adjustable support apparatus as set forth in claim 11 in which one of said connector assemblies is attached to said fine adjustment means, said threaded member being threadedly attached to one end of said one of said telescoping members and fixed relative thereto by a lock nut engaging said threaded member and said one end of said one of said telescoping members, disengagement of said lock nut from said one end of said one of said telescoping members permitting removal of said fine adjustment means and said one of said connector assemblies from the rest of said apparatus.

* * * * *

UNITED STATES PATENT OFFICE

CERTIFICATE OF CORRECTION

Patent No. 4,304,078 Dated December 8, 1981

Inventor(s) IRVIN F. MERIWETHER

It is certified that error appears in the above-identified patent and that said Letters Patent are hereby corrected as shown below:

Column 7, line 34, "2" should be -- 1 --.

Column 8, line 6, "brake" should be -- brace --.

Signed and Sealed this

Sixteenth Day of March 1982

[SEAL]

Attest:

GERALD J. MOSSINGHOFF

Attesting Officer

Commissioner of Patents and Trademarks